US010435969B2

(12) United States Patent
Galley et al.

(10) Patent No.: US 10,435,969 B2
(45) Date of Patent: Oct. 8, 2019

(54) HYDRAULIC CONTROL OF BOREHOLE TOOL DEPLOYMENT

(71) Applicant: Halliburton Energy Services, Inc., Houston, TX (US)

(72) Inventors: Thomas Paul Galley, Spring, TX (US); Daniel M. Winslow, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 14/387,276

(22) PCT Filed: Oct. 31, 2013

(86) PCT No.: PCT/US2013/067865
§ 371 (c)(1),
(2) Date: Sep. 23, 2014

(87) PCT Pub. No.: WO2015/065452
PCT Pub. Date: May 7, 2015

(65) Prior Publication Data
US 2016/0251920 A1 Sep. 1, 2016

(51) Int. Cl.
*E21B 21/10* (2006.01)
*E21B 10/32* (2006.01)
(Continued)

(52) U.S. Cl.
CPC ..... *E21B 21/103* (2013.01); *E21B 3/00* (2013.01); *E21B 10/32* (2013.01); *E21B 10/322* (2013.01);
(Continued)

(58) Field of Classification Search
CPC ..... E21B 21/10; E21B 10/322; E21B 34/08; E21B 34/085; E21B 21/103; E21B 21/08;
(Continued)

(56) References Cited

U.S. PATENT DOCUMENTS 5,103,906 A * 4/1992 Schultz ..... E21B 34/108 166/169
5,183,115 A 2/1993 Gano
(Continued)

FOREIGN PATENT DOCUMENTS

WO WO-03/048509 A1 6/2003
WO WO-2011/061239 A2 5/2011
(Continued)

OTHER PUBLICATIONS

"International Application Serial No. PCT/US2013/067865, International Preliminary Report on Patentability dated May 12, 2016", 8 pgs.
(Continued)

*Primary Examiner* — Nicole Coy
(74) *Attorney, Agent, or Firm* — Chamberlain Hrdlicka

(57) ABSTRACT

A control mechanism for a drill string tool is configured to activate the drill string tool by hydraulically actuated movement of the switching element to an activated position, with drilling mud serving as actuating medium. Movement of the switching element to the activated position is automatically regulated, so that tool activation is conditional upon application of above-threshold downhole drilling fluid conditions for at least a predetermined switching duration. A switch regulator that regulates movement of the switching element to the activated position can be configured to regulate a rate of movement of the switching element such that a substantially constant switching duration is maintained regardless of fluctuations in the magnitude of an actuating pressure differential during above-threshold downhole drilling fluid conditions.

21 Claims, 4 Drawing Sheets

(51) Int. Cl.

| | |
|---|---|
| ***E21B 44/00*** | (2006.01) |
| ***E21B 21/08*** | (2006.01) |
| ***E21B 3/00*** | (2006.01) |
| ***E21B 34/08*** | (2006.01) |
| ***E21B 34/14*** | (2006.01) |

(52) U.S. Cl.
CPC ..... *E21B 21/08* (2013.01); *E21B 21/10* (2013.01); *E21B 34/08* (2013.01); *E21B 34/14* (2013.01); *E21B 44/005* (2013.01)

(58) Field of Classification Search
CPC ..... E21B 44/005; E21B 3/00; E21B 34/14; E21B 10/32
See application file for complete search history.

(56) References Cited

U.S. PATENT DOCUMENTS

| | | | | |
|---|---|---|---|---|
| 6,708,785 | B1 | 3/2004 | Russell et al. | |
| 7,004,266 | B2 | 2/2006 | Russell et al. | |
| 7,252,163 | B2 | 8/2007 | Ollerenshaw et al. | |
| 7,520,333 | B2 | 4/2009 | Turner et al. | |
| 7,793,732 | B2 * | 9/2010 | Xu | E21B 17/20 166/325 |
| 8,074,718 | B2 | 12/2011 | Roberts | |
| 8,863,843 | B2 * | 10/2014 | Wu | E21B 10/32 166/319 |
| 2005/0072572 | A1 | 4/2005 | Churchill | |
| 2007/0012440 | A1 | 1/2007 | Lee et al. | |
| 2007/0089912 | A1 | 4/2007 | Eddison et al. | |
| 2010/0089644 | A1 | 4/2010 | Heemann et al. | |
| 2011/0127044 | A1 * | 6/2011 | Radford | E21B 10/322 166/373 |
| 2011/0284233 | A1 * | 11/2011 | Wu | E21B 10/32 166/321 |
| 2012/0055684 | A1 | 3/2012 | Zimmerman et al. | |
| 2012/0055714 | A1 | 3/2012 | Adam | |
| 2012/0080231 | A1 | 4/2012 | Radford et al. | |
| 2012/0103594 | A1 | 5/2012 | Hall et al. | |
| 2012/0199363 | A1 * | 8/2012 | Hu | E21B 10/322 166/373 |
| 2014/0318806 | A1 * | 10/2014 | Machocki | E21B 23/006 166/373 |
| 2015/0014061 | A1 * | 1/2015 | Wu | E21B 10/32 175/57 |
| 2015/0292281 | A1 * | 10/2015 | Hardin, Jr. | E21B 10/322 166/374 |
| 2016/0130897 | A1 * | 5/2016 | Machocki | E21B 23/006 166/244.1 |

FOREIGN PATENT DOCUMENTS

| | | | | |
|---|---|---|---|---|
| WO | WO 2014133487 | A2 * | 9/2014 | E21B 21/08 |
| WO | WO-2015/065452 | A1 | 5/2015 | |
| WO | WO-2015/065452 | A8 | 5/2015 | |

OTHER PUBLICATIONS

McCarthy, John P., et al., "Truly Selective Underreaming: Adaptation of a Field-Proven, Hydraulically Actuated, Concentric Underreamer Allows for Multiple Locking/Unlocking Cycles in a Single Run", *IADC/SPE 1289541, IADC/SPE Drilling Conference and Exhibition*, Feb. 2-4, New Orleans, Louisiana, USA, (2010), 1-5.
"International Application Serial No. PCT/US2013/067865, International Search Report dated Jul. 24, 2014", 3 pgs.
"International Application Serial No. PCT/US2013/067865, Written Opinion dated Jul. 24, 2014", 6 pgs.

* cited by examiner

HYDRAULIC CONTROL OF BOREHOLE TOOL DEPLOYMENT

PRIORITY APPLICATION

This application is a U.S. National Stage Filing under 35 U.S.C. 371 from International Application No. PCT/US2013/067865, filed on 31 Oct. 2013; which is incorporated herein by reference in its entirety.

TECHNICAL FIELD

The present application relates generally to drilling tools in drilling operations, and to methods of operating drilling tools. Some embodiments relate more particularly to drilling fluid-activated drill string tool control and/or deployment systems, apparatuses, and mechanisms, and to methods for controlling operation of downhole drill string tools. The disclosure also relates to downhole reamer deployment control by controlling downhole pressure conditions of drilling fluid, e.g., drilling mud, conveyed by a drill string.

BACKGROUND

Boreholes are drilled for exploration and production of hydrocarbons, such as oil and gas. A borehole is typically drilled with a drill bit provided at the lower end of a drill string. The drill string typically includes multiple tubular segments, referred to as "drill pipe," connected together end-to-end. The drill bit may be included with a bottom hole assembly (BHA) that has other mechanical and electromechanical tools to facilitate the drilling process. Rotating the drill bit against the formation shears or crushes material of the rock formation to drill the wellbore.

The drill string often includes tools or other devices that can be located downhole during drilling operations, such as in the BHA or elsewhere along the drill string. Remote activation and deactivation of the drill string tools and/or devices may therefore be desired. Such tools and devices include, for example, reamers, stabilizers, steering tools for steering the drill bit, and formation testing devices.

Various methods of remotely controlling downhole tool activation by controlling pressure levels of drilling fluid in the have been devised. The drilling fluid is typically "mud" that is cycled down the interior of the drill string and back up a borehole annulus. Some fluid pressure-operated reamer activation apparatuses, for example, make use of a ball-drop mechanism that permits a single activation cycle, after which a reset of the control system is needed.

BRIEF DESCRIPTION OF THE DRAWINGS

Some embodiments are illustrated, by way of example and not by limitation, in the figures of the accompanying drawings.

DETAILED DESCRIPTION

The following detailed description describes example embodiments of the disclosure with reference to the accompanying drawings, which depict various details of examples that show how the disclosure may be practiced. The discussion addresses various examples of novel methods, systems and apparatuses in reference to these drawings, and describes the depicted embodiments in sufficient detail to enable those skilled in the art to practice the disclosed subject matter. Many embodiments other than the illustrative examples discussed herein may be used to practice these techniques. Structural and operational changes in addition to the alternatives specifically discussed herein may be made without departing from the scope of this disclosure.

In this description, references to "one embodiment" or "an embodiment," or to "one example" or "an example" in this description are not intended necessarily to refer to the same embodiment or example; however, neither are such embodiments mutually exclusive, unless so stated or as will be readily apparent to those of ordinary skill in the art having the benefit of this disclosure. Thus, a variety of combinations and/or integrations of the embodiments and examples described herein may be included, as well as further embodiments and examples as defined within the scope of all claims based on this disclosure, as well as all legal equivalents of such claims.

One aspect of the disclosure describes a drill string tool control mechanism configured to activate a downhole drill string tool by hydraulic drilling fluid actuation of a switch ram to an activated position, a rate of movement of the switch ram to the activated position being regulated so that tool activation is conditional upon application of above-threshold drilling fluid conditions for a least a predetermined switching duration.

The control mechanism may a passive mechanical system, being configured such that functional operation of the control mechanism responsive to pressure difference variations is substantially exclusively mechanical, comprising, e.g., one or more hydraulic actuating mechanisms, spring biasing mechanisms, and cam mechanisms). In such a case, at least those parts of the control mechanism that provide the disclosed functionalities may operate without contribution from any substantially non-mechanical components (e.g., electrical components, electromechanical components, or electronic components).

Figure 1:
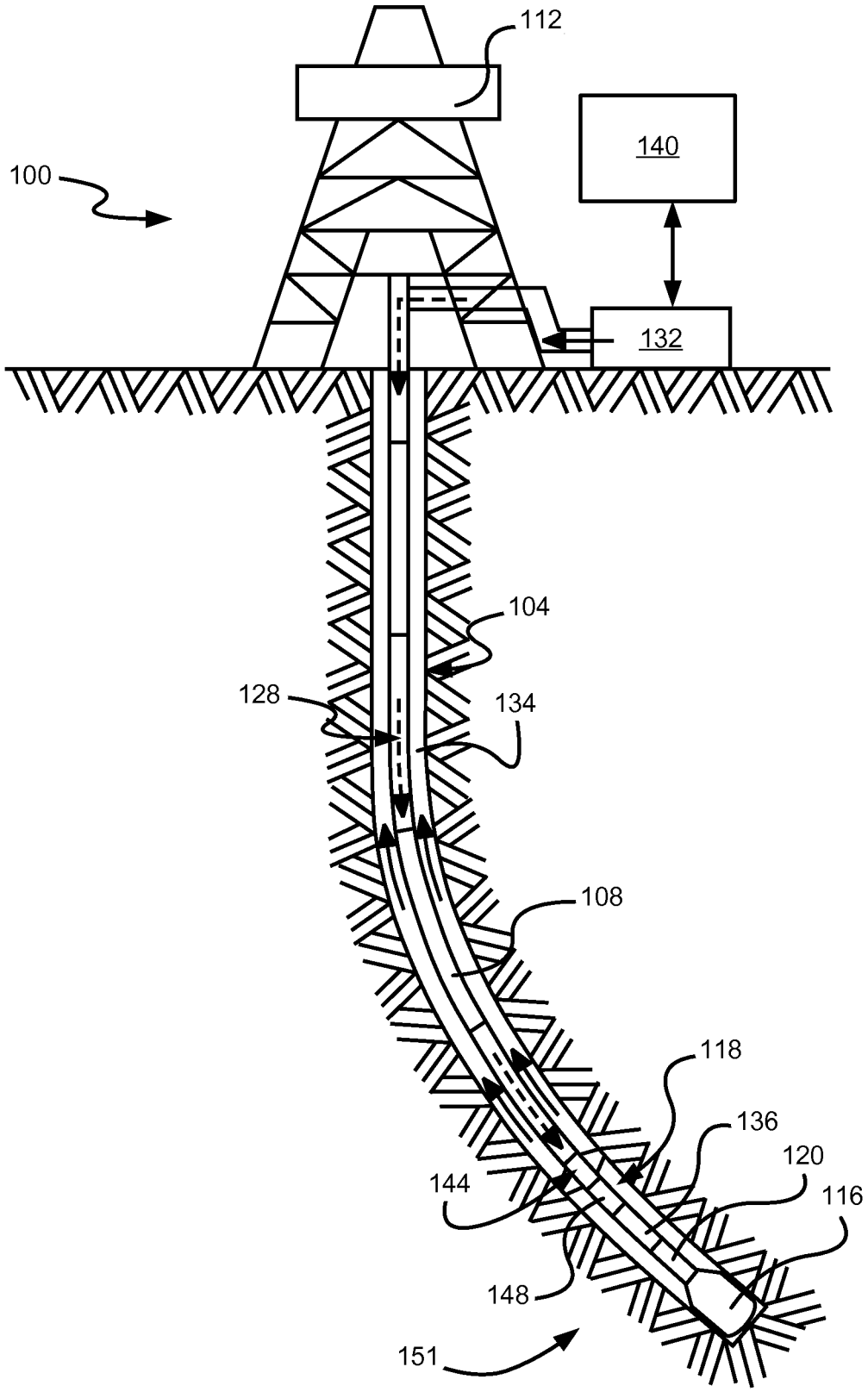
FIG. 1 is a schematic elevational diagram of a drilling installation including a drill tool assembly comprising a drill string tool and an associated well tool having a drilling fluid-operable control mechanism for hydraulically actuated tool deactivation, in accordance with an example embodiment.

FIG. 1 is a schematic view of an example embodiment of a system to control hydraulically actuated activation and hydraulically actuated deactivation of the drill string tool by operator control of pressure conditions of a drilling fluid (e.g., drilling mud).

A drilling installation 100 includes a subterranean borehole 104 in which a drill string 108 is located. The drill string 108 may comprise jointed sections of drill pipe suspended from a drilling platform 112 secured at a wellhead. A downhole assembly or bottom hole assembly (BHA) 151 at a bottom end of the drill string 108 may include a drill bit 116 to crush earth formations, piloting the borehole 104, and may further include one or more tool assemblies in the example form of reamer assemblies 118, uphole of the drill bit 116 to widen the borehole 104 by operation of selectively deployable cutting elements. A measurement and control assembly 120 may be included in the BHA 151, which also includes measurement instruments to measure borehole parameters, drilling performance, and the like.

The borehole 104 is thus an elongated cavity that is substantially cylindrical, having a substantially circular cross-sectional outline that remains more or less constant along the length of the borehole 104. The borehole 104 may in some cases be rectilinear, but may often include one or more curves, bends, doglegs, or angles along its length. As used with reference to the borehole 104 and components therein, the "axis" of the borehole 104 (and therefore of the drill string 108 or part thereof) means the longitudinally extending centerline of the cylindrical borehole 104 (corresponding, for example, to longitudinal axis 367 in FIG. 3).

"Axial" and "longitudinal" thus means a direction along a line substantially parallel with the lengthwise direction of the borehole 104 at the relevant point or portion of the borehole 104 under discussion; "radial" means a direction substantially along a line that intersects the borehole axis and lies in a plane perpendicular to the borehole axis; "tangential" means a direction substantially along a line that does not intersect the borehole axis and that lies in a plane perpendicular to the borehole axis; and "circumferential" or "rotational" means a substantially arcuate or circular path described by rotation of a tangential vector about the borehole axis. "Rotation" and its derivatives mean not only continuous or repeated rotation through 360° or more, but also includes angular or circumferential displacement of less than 360°.

As used herein, movement or location "forwards" or "downhole" (and related terms) means axial movement or relative axial location towards the drill bit 116, away from the surface. Conversely, "backwards," "rearwards," or "uphole" means movement or relative location axially along the borehole 104, away from the drill bit 116 and towards the earth's surface. Note that in FIGS. 2, 3, and 4 of the drawings, the downhole direction of the drill string 108 extends from left to right.

Drilling fluid (e.g. drilling "mud," or other fluids that may be in the well), is circulated from a drilling fluid reservoir, for example a storage pit, at the earth's surface (and coupled to the wellhead) by a pump system 132 that forces the drilling fluid down an internal bore 128 provided by a hollow interior of the drill string 108, so that the drilling fluid exits under relatively high pressure through the drill bit 116. After exiting from the drill string 108, the drilling fluid moves back upwards along the borehole 104, occupying a borehole annulus 134 defined between the drill string 108 and a wall of the borehole 104. Although many other annular spaces may be associated with the system, references to annular pressure, annular clearance, and the like, refer to features of the borehole annulus 134, unless otherwise specified or unless the context clearly indicates otherwise.

Note that the drilling fluid is pumped along the inner diameter (i.e., the bore 128) of the drill string 108, with fluid flow out of the bore 128 being restricted at the drill bit 116. The drilling fluid then flows upwards along the annulus 134, carrying cuttings from the bottom of the borehole 104 to the wellhead, where the cuttings are removed and the drilling fluid may be returned to the drilling fluid reservoir 132. Fluid pressure in the bore 128 is therefore greater than fluid pressure in the annulus 134. Tool activation through control of drilling fluid conditions may thus comprise controlling a pressure differential between the bore 128 and the annulus 134, although downhole drilling fluid conditions may, in other embodiments, be referenced to isolated pressure values in the bore 128. Unless the context indicates otherwise, the term "pressure differential" means the difference between general fluid pressure in the bore 128 and pressure in the annulus 134.

In some instances, the drill bit 116 is rotated by rotation of the drill string 108 from the platform 112. In this example embodiment, a downhole motor 136 (such as, for example, a so-called mud motor or turbine motor) disposed in the drill string 108 and, this instance, forming part of the BHA 151, may contribute to rotation of the drill bit 116. In some embodiments, the rotation of the drill string 108 may be selectively powered by surface equipment, by the downhole motor 136, or by both the surface equipment and the downhole motor 136.

The system may include a surface control system 140 to receive signals from downhole sensors and telemetry equipment, the sensors and telemetry equipment being incorporated in the drill string 108, e.g. forming part of the measurement and control assembly 120. The surface control system 140 may display drilling parameters and other information on a display or monitor that is used by an operator to control the drilling operations. Some drilling installations may be partly or fully automated, so that drilling control operations (e.g., control of operating parameters of the motor 136 and control of drill string tool deployment through control of downhole drilling fluid pressure conditions, as described herein) may be either manual, semi-automatic, or fully automated. The surface control system 140 may comprise a computer system having one or more data processors and data memories. The surface control system 140 may process data relating to the drilling operations, data from sensors and devices at the surface, data received from downhole, and may control one or more operations of drill string tools and/or surface devices.

The drill string 108 may include one or more drill string tools instead of or in addition the reamer assembly 118. The drill string tools of the drill string 108, in this example, thus includes at least one reamer assembly 118 located in the BHA 151 to enlarge the diameter of the borehole 104 as the BHA 151 penetrates the formation. In other embodiments, the drill string 108 may comprise multiple reamer assemblies 118, for example being located adjacent opposite ends of the BHA 151 and being coupled to the BHA 151.

Figure 2:
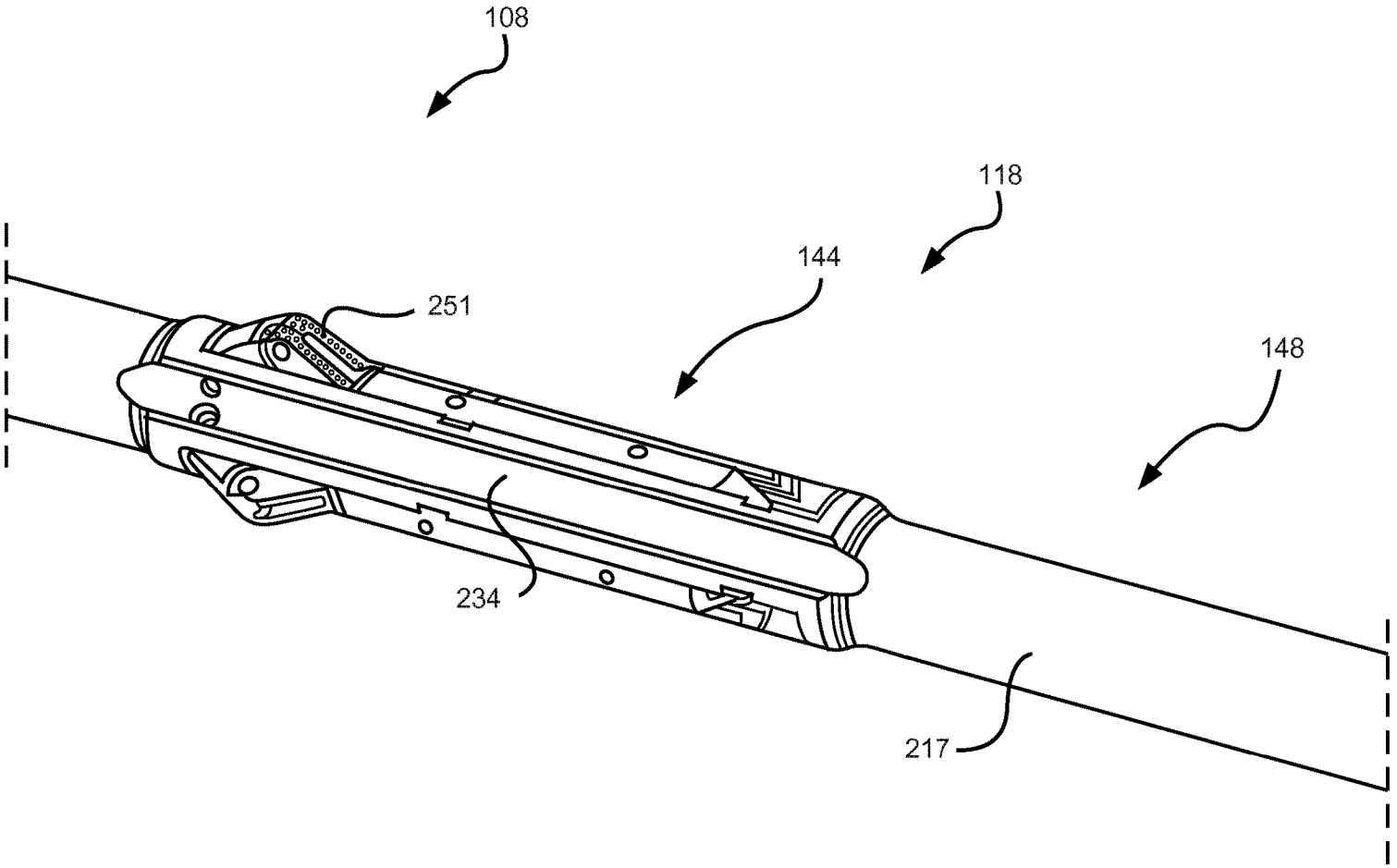
FIG. 2 is a three-dimensional view of a reamer assembly comprising a reamer and a controller configured for selective hydraulically actuated tool deployment, in accordance with an example embodiment.

Each reamer assembly 118 may comprise one or more circumferentially spaced blades or other cutting elements that carry cutting structures (see, e.g., reamer arms 251 in FIG. 2). The reamer assembly 118 includes a drill string tool in the example form of a reamer 144 that comprises a generally tubular reamer housing 234 connected in-line in the drill string 108 and carrying the reamer arms 251. The reamer arms 251 are radially extendable and retractable from a radially outer surface of the reamer housing 234, to selectively expand and contract the reamer's effective diameter.

Controlling deployment and retraction of the reamer 144 (e.g., to switch the reamer 144 between a deployed condition in which the reamer arms 251 project radially outwards for cutting into the borehole wall, and a dormant condition in which the reamer arms 251 are retracted) may be controlled by controlling pressure conditions in the drilling fluid. In addition, deployment of the reamer arms 251 may be hydraulically actuated by agency of the drilling fluid.

In this example the reamer assembly 118 includes a well tool coupled to the reamer 144 and configured for controlling operation of the reamer 144. The controlling well tool (which is thus a subassembly of the reamer assembly 118) is in the example form of a controller 148 that provides deployment control mechanisms configured to provide lagged hydraulically actuated deployment of the reamer 144 responsive to drilling fluid pressures at the controller 148 that are above a predetermined threshold level. The controller 148 may comprise an apparatus having a drill-pipe body or housing 217 (see FIG. 2) connected in-line in the drill string 108. In the example embodiment of FIG. 1, the controller 148 is mounted downhole of the reamer 144, but in other embodiments, the positional arrangement of the controller 148 and the reamer 144 may be different, with the controller 148, for example, being mounted uphole of the reamer 144.

Although fluid-pressure control of tool deployment (example mechanisms of which will be discussed presently) provides a number of benefits compared, e.g., to electromechanical deployment mechanisms, such fluid-pressure control may introduce difficulties in performing drilling operations. There is seldom, for example, a simple direct correspondence between fluid pressure values and desired reamer deployment. Although reaming operations in this example coincide with high fluid pressure in the bore 128 (also referred to as bore pressure or internal pressure), it is seldom desirable for the reamer 144 to be deployed upon every occurrence of high bore pressures, which may result in inadvertent reamer deployment. The example controller 148 provides an automatic delay mechanism or lag switch arrangement that allows deployment of the reamer 144 only if the drilling mud pressure is maintained above-threshold levels for at least a controlled, substantially consistent switching duration.

FIG. 2 shows an example embodiment of a reamer assembly 118 that may form part of the drill string 108, with the reamer 144 that forms part of the reamer assembly 118 being in a deployed condition. In this deployed (or activated) condition, reamer cutting elements in the example form of the reamer arms 251 are radially extended, standing proud of the reamer housing 234 and projecting radially outwards from the reamer housing 234 to make contact with the borehole wall for reaming of the borehole 104 when the reamer housing 234 rotates with the drill string 108. In this example, the reamer arms 251 are mounted on the reamer housing 234 in axially aligned, hingedly connected pairs that jackknife into deployment, when activated. When, in contrast, the reamer 144 is in the deactivated condition, the reamer arms 251 are retracted into the tubular reamer housing 234. In the retracted mode, the reamer arms 251 do not project beyond the radially outer surface of the reamer housing 234, therefore clearing the annulus 134 and allowing axial and rotational displacement of the reamer housing 234 as part of the drill string 108, without engagement of a borehole wall by the reamer arms 251. Different activation mechanisms for the reamer assembly 118 may be employed in other embodiments. Note, for example, that the reamer arms 251 are shown in the example embodiment of FIG. 3 as directly connected to the controller 148, while the example embodiment of FIG. 2 comprises reamer arms 251 connected to the controller 148 by a linkage mechanism (not shown) internal to the reamer housing 234.

Figure 3A:
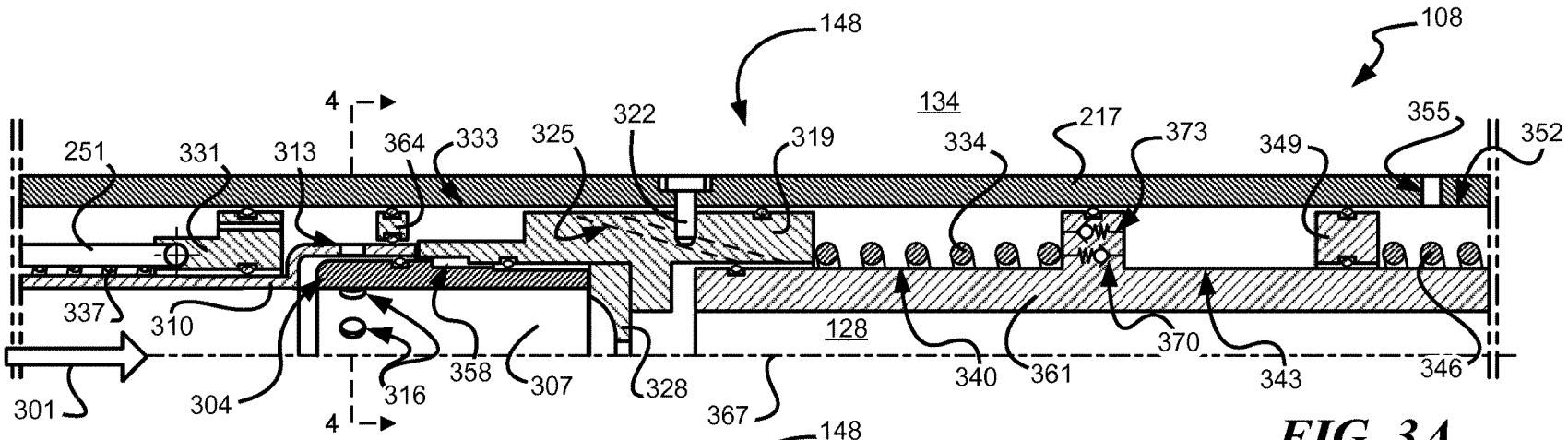
FIGS. 3A and 3B are schematic views depicting respective partial longitudinal sections of a controller assembly for a drill string tool, in accordance with an example embodiment, a deployment mechanism forming part of the controller assembly being shown in FIG. 3A in a closed condition in which the drill string tool is deactivated, with the control mechanism being shown in FIG. 3B in an open condition in which the drill string tool is deployed.
Figure 3B:
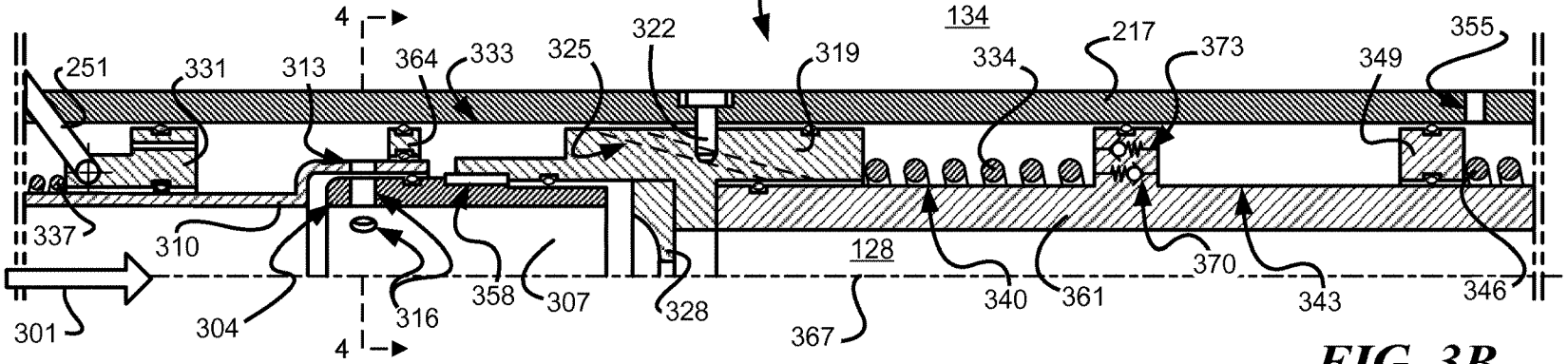

FIGS. 3A and 3B schematically illustrate internal components of the example embodiment of the controller 148, being operatively connected to the reamer 144 in the reamer assembly 118. The controller 148 has a generally tubular housing 217 that may comprise co-axially connected drill pipe sections which are connected in-line with and form part of the tubular body of the drill string 108. The drill pipe sections may be connected together by screw-threaded engagement of complementary connection formations at adjacent ends of the respective drill pipe sections, to form a screw threaded joint. The housing 217 is thus incorporated in the drill string, to transfer torque and rotation from one end of the housing 217 to the other. Internal components of the controller 148 further configured to form a part of the bore 128, to convey drilling fluid from one end to the other in a fluid flow direction, indicated schematically by arrow 301 in FIGS. 3A and 3B.

The controller 148 includes a hydraulic tool deployment mechanism comprising, in this example, a reamer piston 331 which is mounted in the housing 217 for hydraulically actuated reciprocating longitudinal movement to deploy and retract the reamer 144. The reamer piston 331 is held captive in an annular space bordered radially by the housing 217 and a generally tubular valve stator 310 mounted co-axially in the housing 217, being longitudinally slidable along the annular space.

The reamer piston 331 sealingly separates this annular space into two hydraulic chambers to opposite longitudinal sides thereof. An activation volume in the example form of an actuation chamber 333 is provided (in this example) to the downhole side of the reamer piston 331. The annular space immediately uphole of the reamer piston 331 is substantially at annulus pressure, the housing 217 providing one or more nozzles or passages (not shown) from the annulus 134 into the housing uphole of the reamer piston 331. When a hydraulic medium in the actuation chamber 333 (in this example drilling mud) is at an elevated pressure relative to the annulus pressure, e.g., being at bore pressure, a pressure differential across the reamer piston 331 in the uphole direction results in hydraulic actuation of the reamer piston 331 uphole. In this example, the reamer arms 251 are directly coupled to the reamer piston 331, so that hydraulically actuated uphole displacement of the reamer piston 331 causes deployment of the reamer arms 251 by pivoting thereof relative to the reamer piston 331 on which at least one of the reamer arms 251 is mounted. In other embodiments, the reamer piston 331 may be connected to the reamer arms 251 by a mechanical linkage, a hydraulic connection, or the like. The tool deployment mechanism provided by the controller 148 further comprises a reamer spring 337 configured to exert a retraction bias on the reamer piston 331, acting against hydraulically actuation of the reamer piston 331 and, in this example, urging the reamer piston 331 downhole towards a dormant position (FIG. 3A).

The controller 148 further comprises a valve arrangement to selectively control fluid flow between the bore 128 and the actuation chamber 333, thereby to select hydraulically actuated movement (and, by extension, spring-biased return) of the reamer piston 331. The valve arrangement in this example embodiment comprises a rotary valve 304 having a generally tubular valve body in the example form of the valve stator 310. The valve stator 310 is mounted co-axially in the housing 217, an inner diameter of the valve stator 310 defining the bore 128 for a part of the length of the controller 148. The valve stator 310 has a valve port arrangement in the example form of four valve ports 313 (see also FIG. 4) arranged in a regularly spaced circumferentially extending series, each valve port 313 extending radially through a tubular wall of the valve stator 310, providing a fluid flow connection between the bore 128 and the actuation chamber 333.

The rotary valve 304 further comprises a displaceable valve member or valve closing element in the example form of a valve rotor 307 which is generally tubular and is mounted co-axially in the valve stator 310, being angularly displaceable (also described herein as being rotatable) relative to the valve stator 310 about a valve axis that is co-axial with a common longitudinal axis 367 of the housing 217 and the valve stator 310. The valve rotor 307 provides a circumferentially extending series of spaced valve openings 316 (in this example, four regularly spaced openings) extending radially through a tubular body of the valve rotor 307. The valve openings 316 correspond in size and circumferential placement to the valve ports 313, so that the valve rotor is angularly displaceable between an open condition (FIG. 3B and FIG. 4B) in which the valve openings 316 are respectively in register with a corresponding valve ports 313, to place the actuation chamber 333 in fluid communication with the bore 128, and a closed condition in which the valve openings 316 are out of register with the corresponding valve ports 313, shutting the valve ports 313 and placing the actuation chamber in fluid flow isolation from the bore 128.

The controller 148 further comprises a switch member or hydraulic switch ram in the example form of a barrel cam 319 which is coupled to the rotary valve 304 and is configured to switch the valve rotor 307 from its closed condition to its open condition in response to above-threshold bore pressure conditions. In this example, the barrel cam 319 is mounted in the housing 217 for both reciprocating longitudinal movement and reciprocating rotational moment during a tool deployment/deactivation cycle.

The barrel cam 319 includes a hydraulic drive mechanism to cause hydraulically actuated longitudinal movement of the barrel cam 319 in the housing 217 responsive to the above-threshold bore pressures. In the example embodiment of FIG. 3, the hydraulic drive mechanism for the switch ram provided by the barrel cam 319 comprises a constriction in the bore 128, the constriction being provided by a drive nozzle 328 fixedly mounted co-axially on the barrel cam 319 and providing a nozzle orifice of reduced diameter in the bore 128. Downhole flow of pressurized drilling mud, in operation, will therefore result in a pressure drop across the drive nozzle 328, driving hydraulic actuation of the drive nozzle 328 (and therefore of the barrel cam 319) in an activation direction (in this example being longitudinally downwards, i.e., from left to right in FIG. 3A).

The controller 148 further comprises a rotation mechanism to cause rotation of the barrel cam 319 about the longitudinal axis 367 in response to longitudinal movement of the barrel cam 319 along the housing 217. The rotation mechanism in this example embodiment comprises a cam mechanism comprising a cam pin 322 mounted on the housing 217 and projecting radially inwards therefrom. The cam pin 322 being received in a complementary cam groove 325 defined in a radially outer surface of the barrel cam 319. The cam groove 325 is part-helical, being inclined relative to the longitudinal axis 367. Because the barrel cam 319 is a rotatable within the housing 217 while the cam pin 322 is keyed against rotation relative to the housing, the cam groove 325 follows the cam pin 322 during longitudinal movement of the barrel cam 319, rotating the barrel cam 319 about the longitudinal axis 367.

The barrel cam 319 is coupled to the valve rotor 307 to transmit angular displacement/rotation to the valve rotor 307, thereby to open or close the rotary valve 304. In this example embodiment, the valve rotor 307 is longitudinally anchored to the housing 217, having a fixed longitudinal position, while being rotationally keyed to the barrel cam 319. A rotation-transmitting coupling between the barrel cam 319 and the valve rotor 307 in this example comprises a spline joint 358 having complementary mating longitudinally extending splines on a radially outer surface of the valve rotor 307 and on a radially inner surface of a complementary socket formation of the barrel cam 319, respectively.

Hydraulically actuated movement of the barrel cam 319 in the activation direction (i.e., downhole in this example), however, is restrained or retarded by a hydraulic switch regulator, so that completion of any particular instance of an activation stroke of the barrel cam 319 can be no quicker than a predetermined, consistent minimum switching interval, irrespective of the magnitude of particular above-threshold bore pressures that may apply and that may differ between cycles, or may differ between installations. In this example, the switch regulator comprises a regulator volume 340 which is filled with substantially incompressible hydraulic medium and is configured automatically to reduce in volume (i.e., to compress the volume) in response to longitudinal movement of the barrel cam 319 in the activation direction, evacuation of the hydraulic medium (e.g., oil) from the regulator volume 340 being channeled through a hydraulic constriction at which a rate of flow of the hydraulic medium from the regulator volume 340 may be controlled or regulated. In the example embodiment illustrated in FIG. 3A, the regulator volume 340 is defined in an annular space radially bordered by the housing 217 and an inner tube 361 co-axially mounted in the housing 217. An evacuation volume in the example form of reservoir chamber 343 is located to a downhole side of the regulator volume 340, being separated from the regulator volume 340 by a chamber wall provided by a circumferentially extending annular rib projecting radially outwards from the inner tube 361. A pair of fluid flow passages extend longitudinally through the chamber wall, being configured for permitting unidirectional flow in opposite respective longitudinal directions by provision therein of respective one-way valves (which are described at greater length below).

One of the flow passages provides an evacuation passage which permits flow only from the regulator volume 340 to the reservoir chamber 343, while preventing flow therethrough in the opposite direction. This is achieved by provision in the evacuation passage of a flow regulator in the example form of a flow control device 370. The example flow control device 370 comprises a check valve that permits flow only in the activation direction (i.e., downhole in this example embodiment), and that restricts liquid flow therethrough by imposing an upper limit on the flow rate. The flow control device 370 therefore allows oil flow through it at a rate no higher than a predetermined flow rate limit, irrespective of the magnitude of an above-threshold pressure differential across it. In this example embodiment, the flow control device 370 comprises a Lee Flosert™ device graded to limit flow to 0.1 gpm, but it should be noted that the grading of the flow control device 370 can be modified depending on the requirements of the particular implementation. The flow control device 370 may be configured to function as a check valve, e.g. to prevent flow therethrough even in the activation direction below a predefined cracking pressure (which may substantially correspond to a social bore-annulus pressure differential for the controller 148), and to limit the flow rate through it in the activation direction for above-threshold pressure differentials to the specified flow rate limit, no matter how high the pressure differential.

Because the evacuation passage in which the flow control device 370 is mounted is the socially evacuation around for the hydraulic medium (e.g., oil) with which the regulator volume 340 is filled, downhole movement of the barrel cam 319 is dependent on oil flow through the flow control device 370, and a speed at which the barrel cam 319 moves downhole is retarded or restricted to a activation speed limit corresponding to the flow rate limit of the flow control device 370.

The controller 148 further comprises a bias mechanism to bias the barrel cam 319 towards the longitudinal position corresponding to the closed condition of the valve rotor 307 (FIG. 3A). In this example embodiment, the bias mechanism comprises a return spring 334 that comprises a helical compression spring mounted co-axially on the inner tube 361 in the regulator volume 340 and acting longitudinally between the annular wall of the regulator chamber and the barrel cam 319.

In addition to the evacuation passage, a return passage extends through the chamber wall between the regulator volume 340 and the reservoir chamber 343, a unidirectional return valve 373 being mounted in the return passage to permit on flow therethrough in a return direction only (i.e., uphole in this example embodiment).

The described example embodiment employs oil as a hydraulic medium for delaying or slowing movement of the barrel cam 319 towards a position where the reamer 144 is deployed. To separate the oil from drilling mud, while exploiting the bore-annulus pressure differential for hydraulic actuation of various controller components, a floating wall 349 defines a downhole end of the reservoir chamber 343. The floating wall 349 comprises an annular member which is in sealing engagement with the inner diameter of the housing 217 and with an outer diameter of the inner tube 361, being longitudinally slidable for diaphragm-fashion equalization between fluid pressures in the reservoir chamber 343 and in a pressure balance volume 352 located immediately downhole of the floating wall 349. The pressure balance volume 352 is exposed to drilling fluid at annular pressure by provision of one or more annulus nozzles 355 in the housing 217. Through operation of the pressure balance volume 352 and the floating wall 349, oil pressure in the reservoir chamber 343 may be kept at pressure values more or less equal to annulus pressure. Fluid pressure in the reservoir chamber 343, however, may be somewhat amplified by operation of a balance spring 346 acting on the floating wall 349, urging it uphole.

An analogous separator ring 364 may be provided between the barrel cam 319 and the reamer piston 331, sealing against the housing 217 and the valve stator 310 respectively, to separate drilling mud in the actuation chamber 333 from hydraulic oil in a volume defined between the separator ring 364 and the barrel cam 319. In some embodiments, the separator ring 364 may be held captive axially between a pair of spaced stops (e.g., annular clips mounted in complementary grooves in the inner diameter of the housing 217). Longitudinal displaceability of the separator ring 364 further serves automatically to compensate for volume changes in the adjacent enclosed volume because of longitudinal movement of the barrel cam 319.

Figure 4A:
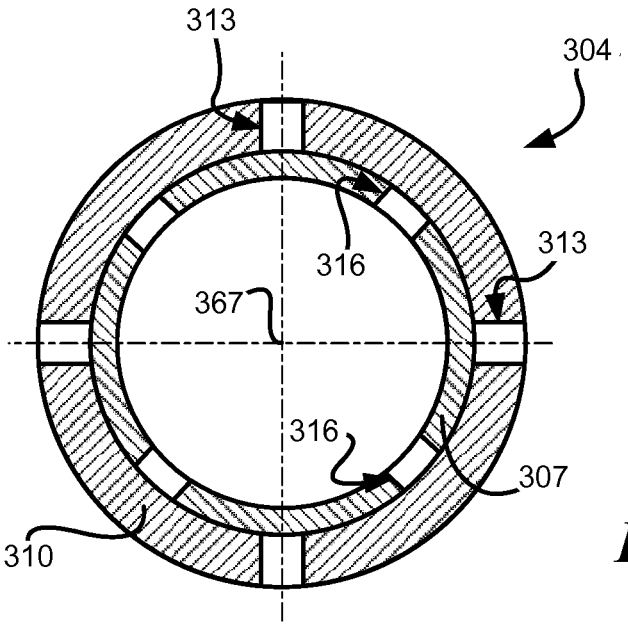
FIG. 4A and FIG. 4B are axial end views of a rotary valve for forming part of a controller assembly such as that illustrated in FIGS. 3A and 3B, in accordance with an example embodiment, the rotary valve being shown in a closed condition in FIG. 4A, and in an open condition in FIG. 4B.
Figure 4B:
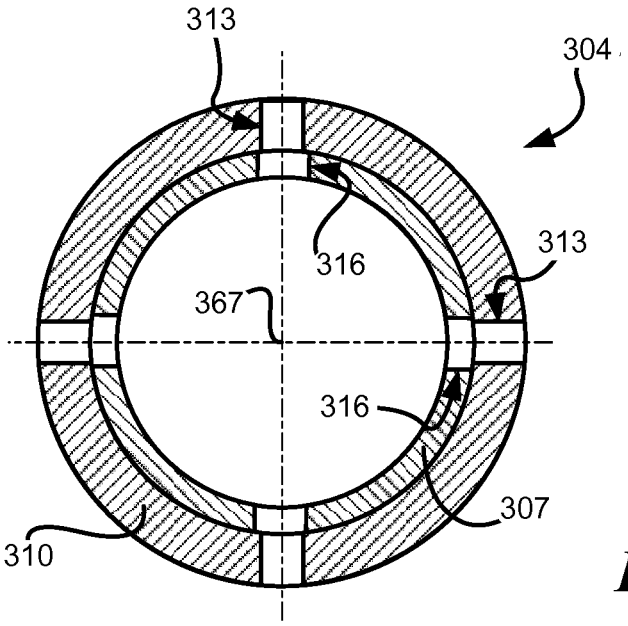

FIGS. 4A and 4B show axial sections of the rotary valve 304 in isolation, taken along line 4-4 in FIGS. 3A and 3B respectively and showing circumferential alignment and misalignment of the valve openings 316 and the valve ports 313 upon rotation of the valve rotor 307 through an angle corresponding to a full activation stroke of the barrel cam 319, in this example being rotation or angular displacement through 45 degrees.

In operation, the reamer 144 is deployed by hydraulic actuation energized or powered by pressurization of the drilling mud, but only if the bore-annulus pressure differential is maintained at a level higher than the predetermined tool-activation threshold for longer than the regulated switching duration governed by regulated flow through the flow control device 370.

Initially, the reamer 144 is retracted, with the rotary valve 304 being in a closed condition (FIG. 3A) and the barrel cam 319 being in an extreme uphole position. When an operator wishes to deploy the reamer 144, bore pressure values are ramped up to above-threshold values.

Responsive to resultant above-threshold drilling fluid conditions at the controller 148, hydraulic actuation forces exerted on the barrel cam 319 in the activation direction (i.e., downhole in this example) by the drive nozzle 328 exceed a peak bias force of the return spring 334 in the opposite return direction (i.e., uphole in this example), and the barrel cam 319 starts moving downhole under hydraulic actuation.

As the barrel cam 319 moves downhole under hydraulic actuation, it is progressively rotated about the longitudinal axis 367 by operation of the cam pin 322 followed by the cam groove 325. During such downhole movement, the barrel cam 319 slides longitudinally away from the valve rotor 307, while transmitting its received rotation to the valve rotor 307 via the spline joint 358. The valve rotor 307 is thus rotated from its closed condition towards its open position, the valve openings 316 being brought progressively closer to circumferential alignment with the valve ports 313. The barrel cam 319 and the valve rotor 307 are configured so that the rotary valve 304 is opened only when the barrel cam 319 has performed a full activation stroke, travelling substantially all the way to an extreme downhole position (FIG. 3B).

Downhole movement of the barrel cam 319, however, is limited to a regulated maximum speed by operation of the flow control device 370. The hydraulically actuated, piston-fashion longitudinal sliding of the barrel cam 319 automatically reduces the size of the regulator volume 340, pressurizing a body of hydraulic oil therein. Because the reservoir chamber 343 is substantially at annulus pressure (via operation of the pressure balance volume 352 and the floating wall 349), a pressure differential is created over the evacuation passage in which the flow control device 370 is located.

Because of the above-threshold pressure conditions, oil therefore flows in the activation direction through the flow control device 370, but at a flow rate no greater than the specified flow rate limit of the flow control device 370. The flow control device 370 may be configured effectively to be operable between a below-threshold condition in which fluid flow therethrough is prevented, and an above-threshold condition in which the oil flow rate therethrough is regulated to be substantially constant. Being a liquid, the hydraulic oil is uncompressible, so that the barrel cam 319 can move downhole no faster than is permitted by evacuation of hydraulic oil from the reservoir chamber 343. The flow control device 370 therefore effectively regulates a speed of movement of the barrel cam 319 axially along the housing during its activation stroke.

To achieve deployment of the reamer 144, the above-threshold pressure conditions must be maintained for at least the predetermined switching duration, allowing sufficient opportunity for the barrel cam 319 to move to the extreme uphole position at which the valve rotor 307 has been rotated sufficiently to bring the valve ports 313 into alignment with the valve openings 316, so that the rotary valve 304 is in its open condition (FIG. 3B). Drilling mud then flows radially from the bore 128 through the valve ports 313 and into the actuation chamber 333. The bore-annulus pressure differential then applies over the reamer piston 331, urging the reamer piston 331 uphole into deployment against the bias provided by the reamer spring 337.

The described components of the controller 148 may be selected and configured such that the regulated switching duration is, e.g., between 3 minutes and 10 minutes In this example embodiment, the regulated switching duration is 5 minutes, so that deployment of the reamer 144 can be achieved only by maintaining drilling mud pressures at above-threshold levels for the predetermined switching duration of 5 minutes, or longer. Particular threshold values may be varied from one embodiment to another, or may be changed within the same drilling installation for use in different tools or for use in different applications for the same tool. Referring again to FIG. 3A, note that the drive nozzle 328 in this example is removably and replaceably mounted on the barrel cam 319. This permits replacement of the drive nozzle 328 when it becomes worn or eroded from extended use, but also allows differently-sized drive nozzles to be fitted in its stead, to configure the controller 148 for tool activation by at a different flow rate. Variation in nozzle size thus causes corresponding variation in flow rates at which the threshold pressure is reached. Instead, or in addition, differently graded return springs 334 can be employed to change the threshold value. Bear in mind, however, that the regulated switching duration will substantially remain constant across such different configurations because the determinative factor for tool switching duration is not the magnitude of hydraulic actuation forces acting on barrel cam 319, but is the rate of oil flow through the flow control device 370 (which remains constant across configurations).

A threshold value for the bore-annulus pressure differential may thus range, for example, between 200 psi and 500 psi. In the example embodiment described herein, the pressure differential may be about 400 psi. Inadvertent provision of above-threshold pressure conditions (which in this example corresponds to pressure levels at which reaming is performed) for such an extended interval is unlikely. The intentional, consistent lag time between applying above-threshold drilling fluid pressures and reamer deployment thus serves to limit the risk of inadvertent tool deployment.

When drilling fluid pressure is reduced to below-threshold levels before expiry of the regulated switching duration, or subsequent to reamer deployment, the reamer arms 251 are retracted through operation of the reamer spring 337, pushing the reamer piston 331 downhole to retract the reamer arms 251. Synchronously, the barrel cam 319 is urged in the return direction (i.e., uphole in this example) by the return spring 334. Return movement of the barrel cam 319 now results in a pressure drop in the regulator volume 340, drawing hydraulic fluid from the reservoir chamber 343 through the return valve 373. Note that, in this example, the return valve 373 does not limit the rate at which the hydraulic medium flows through it, so that (unlike reamer deployment) reamer retraction is not delayed or restrained. Return movement of the barrel cam 319 causes rotation thereof in a reverse direction by operation of its cam arrangement, rotating the valve rotor 307 via the spline joint 358 back to the closed condition in which the valve openings 316 are out of alignment with the valve ports 313 (FIGS. 3A and 4A).

Subsequent deployment and/or retraction of the reamer 144 comprises repeat performance of the above-described deployment-retraction cycle. Note that there is no limit on the number of deployment/retraction cycles that can be performed by the hydraulic actuation mechanism and the control mechanism provided by the controller 148, because the configuration and arrangement of the controller 148's components at completion of the deployment-retraction cycle is identical to their configuration and arrangement at commencement of the cycle.

It is a benefit of the described example assembly and method that allows for multiple tool activation/deactivation sequences. A further benefit is that such multi-cycle deployment is both energized and controlled by agency of drilling fluid native the drill string 108, enabling operator-control of tool deployment mode through control of the drilling fluid conditions. Because the described control mechanism is essentially non-electrical (employing substantially no electrical or electronic equipment for full operability), the controller 148 can be incorporated in existing systems without requiring any additional dedicated control telemetry equipment.

Despite drilling fluid-controlled operation, the control mechanism of the controller 148 limits risks associated with inadvertent tool deployment by provision of the described lagged tool activation. Yet further, the above-mentioned functionalities are achieved without significant sacrifice of effective bore diameter.

In accordance with one aspect of the disclosure, the above-described example embodiments therefore disclose a well tool comprising a housing configured for incorporation in a drill string to convey drilling fluid along an internal bore defined by the housing; a valve body within the housing, the valve body defining a valve port in fluid communication with the internal bore and with an activation volume configured for cooperation with a hydraulic deployment mechanism of a drill string tool; a valve closing element configured for switching between an open condition in which the internal bore is in fluid communication with the activation volume, via the valve port, and a closed condition in which the closing element substantially prevents fluid flow through the valve port; a switch ram coupled to the valve closing element and configured for hydraulically driven movement in an activation direction in response to predefined above-threshold downhole drilling fluid conditions, to switch the valve closing element from the open condition to the closed condition; and a switch regulator coupled to the switch ram and configured to regulate switching of the valve closing element from the closed condition to the open condition by providing regulated hydraulic resistance to movement by the switch ram in the activation direction.

The switch ram can be any hydraulically actuated switching member, and can be configured for any suitable mode of movement. In one example embodiment, the switch ram is configured for longitudinal translation, but in other embodiments, the switch ram may be configured for rotational movement, e.g. being rotational about a longitudinal axis of the drill string, in which case the activation direction is a rotational direction.

The activation volume may be a hydraulic actuation chamber forming part of the hydraulic deployment mechanism of the drill string tool. In other embodiments, the activation volume may be a conduit or passage defined by the valve body or by the housing, the conduit or passage configured for placing the internal bore in fluid connection with the tool deployment mechanism, via the valve port, when the well tool is incorporated in the drill string.

The switch regulator may comprise a switch timing mechanism configured to regulate a switching duration for hydraulically actuated movement of the valve closing element from the closed condition to the open condition in response to exposure to above-threshold drilling fluid conditions, so that the switching duration is substantially independent of variations in the above-threshold drilling fluid conditions between respective instances of tool deployment. The switch regulator may include a hydraulic constriction through which a hydraulic medium is flowable in response to movement of the switch ram in the activation direction, the switch mechanism being configured such that an activation speed (e.g., a speed of movement by the switch ram in the activation direction) is limited by a rate of flow of the hydraulic medium through the hydraulic constriction. The switch regulator may further comprise a flow regulator (e.g., a constant flow unidirectional check valve) mounted in the hydraulic constriction and configured to regulate flow of the hydraulic medium through the hydraulic constriction.

In some embodiments, the flow regulator may comprise a flow rate control device configured to restrict a rate of flow of the hydraulic medium through the hydraulic constriction to a predetermined flow rate limit which is substantially consistent and is independent of fluctuations in a pressure differential across the hydraulic constriction during above-threshold drilling fluid conditions.

The switch regulator may in some embodiments comprise a regulator volume filled with the hydraulic medium and configured to be automatically pressurized in response to movement of the switch ram in the activation direction, and an evacuation passage providing a fluid flow connection between the regulator volume and an accumulation volume, movement of the switch ram in the activation direction being conditional on flow of the hydraulic medium through the evacuation passage (the evacuation passage in such instances providing the hydraulic constriction at which flow rate is regulated) the flow regulator being mounted in the evacuation passage.

The tool assembly may include a rotary valve, wherein the valve closing element is rotatable relative to the housing about a valve axis, the valve closing element configured to be switched between the open condition and the closed condition by angular displacement of the valve closing element about the valve axis. The valve closing element may in such cases be generally tubular may be located co-axially in the housing, so that the valve axis is in alignment with a longitudinal axis of the housing, the valve closing element being configured to define a part of the internal bore of the tool assembly.

In embodiments where the valve closing element is rotatable to cause tool deployment, tool assembly may include a rotation mechanism to cause angular displacement of the switch ram about the longitudinal axis in response to longitudinal movement of the switch ram in the housing. The switch ram may, for example, be rotationally keyed to the valve closing element and may be configured for reciprocating longitudinal movement relative to the housing, to rotate the valve closing element to the open condition in response to hydraulically actuated longitudinal movement of the switch ram in the activating direction when above-threshold drilling fluid conditions are applied, and to rotate the valve closing element to the closed condition in response to longitudinal movement by the switch ram in an opposite return direction when the above-threshold drilling fluid conditions subsequently ceases. The switch ram may be longitudinally slidable relative to the valve closing element, while the valve closing element has fixed longitudinal position relative to the housing The tool assembly may further comprise a bias mechanism (e.g., a resiliently compressible spring) coupled to the switch ram and configured to exert a bias on the switch ram in a longitudinal return direction opposite to the activation direction, the bias mechanism being configured such that the bias matches or exceeds a hydraulic actuating force acting on the switch ram at below-threshold drilling fluid conditions, but is smaller than a hydraulic actuating force acting on the switch ram at above-threshold drilling fluid condition.

Some of the other aspects of the disclosure comprise a drill tool that comprises the drill tool assembly, a drill string incorporating the drill tool assembly, a drilling installation having a drill string that includes the drill tool assembly, and a method that comprises controlling downhole drill string tool deployment by use of the control assembly.

One aspect of the disclosure therefore comprises a method of controlling a drill string tool coupled in a drill string within a borehole, the drill string defining an internal bore to convey drilling fluid under pressure, the method comprising incorporating in the drill string a control mechanism for the drill string tool, the control mechanism comprising: a valve body within the housing, the valve body defining a valve port that provides fluid communication between with the internal bore and a hydraulic deployment mechanism of the drill string tool; a valve closing element configured for switching between an open condition in which the internal bore is in fluid communication with the activation volume, via the valve port, and a closed condition in which the closing element substantially prevents fluid flow through the valve port; a switch ram coupled to the valve closing element and configured for hydraulically driven movement in an activation direction in response to predefined above-threshold downhole drilling fluid conditions, to switch the valve closing element from the open condition to the closed condition; and a switch regulator coupled to the switch ram and configured to regulate switching of the valve closing element from the closed condition to the open condition by providing regulated hydraulic resistance to movement by the switch ram in the activation direction. The method may further comprise controlling downhole drilling fluid conditions from a surface control system, to cause the predefined above-threshold downhole drilling fluid conditions, thereby switching the valve closing element to the open condition and causing deployment the drill string tool.

The method may further comprise regulating a switching duration for which the predefined above-threshold drilling fluid conditions are to persist for causing hydraulically actuated movement of the valve closing element from the closed condition to the open condition, so that the switching duration is substantially independent of variations in the above-threshold drilling fluid conditions between respective instances of tool deployment.

In the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. A well tool for incorporation as part of a drill string for conveying drilling fluid, the tool comprising:

a housing comprising an internal bore;

a valve body within the housing, the valve body comprising a valve port in fluid communication with the internal bore and with an activation volume configured for cooperation with a hydraulic deployment mechanism of a drill string tool;

a valve closing element within the housing and configured for switching between an open condition in which fluid may flow from the internal bore to the activation volume, via the valve port, to pressurize the activation volume and to actuate the hydraulic deployment mechanism, and a closed condition in which the closing element substantially prevents fluid flow through the valve port;

a switch ram within the housing, coupled to the valve closing element, and configured for hydraulically driven movement in an activation direction in response to predefined above-threshold downhole drilling fluid conditions, to switch the valve closing element from the open condition to the closed condition; and a switch regulator within the housing and comprising a flow passage configured to regulate switching of the valve closing element from the closed condition to the open condition by providing regulated hydraulic resistance to movement by the switch ram in the activation direction such that a substantially constant switching duration is maintained regardless of variations in the pressure during above-threshold downhole drilling fluid conditions.

2. The well tool of claim 1, wherein the flow age includes a hydraulic constriction through which a hydraulic medium is flowable in response to movement of the switch ram in the activation direction, the flow passage being configured such that a speed of movement by the switch ram in the activation direction is limited by a rate of flow of the hydraulic medium through the hydraulic constriction.

3. The well tool of claim 2, wherein the switch regulator further comprises a flow regulator mounted in the hydraulic constriction and configured to regulate flow of the hydraulic medium through the hydraulic constriction.

4. The well tool of claim 3, wherein the flow regulator comprises a flow rate control device configured to restrict a rate of flow of the hydraulic medium through the hydraulic constriction to a predetermined flow rate limit which is substantially consistent and is independent of fluctuations in a pressure differential across the hydraulic constriction during above-threshold drilling fluid conditions.

5. The well tool of claim 3, wherein the switch regulator comprises:

a regulator volume filled with the hydraulic medium and configured to be automatically pressurized in response to movement of the switch ram in the activation direction; and wherein the flow passage comprises an evacuation passage providing a fluid flow connection between the regulator volume and an evacuation volume, movement of the switch ram in the activation direction being conditional upon flow of the hydraulic medium through the evacuation passage, so that the evacuation passage provides the hydraulic constriction, the flow regulator being mounted in the evacuation passage.

6. The well tool of claim 1, wherein the valve closing element is rotatable relative to the housing about a valve axis for being switched between the open condition and the closed condition.

7. The well tool of claim 6, wherein the valve closing element is generally tubular and is located co-axially in the housing, the valve axis being in alignment with a longitudinal axis of the housing, the valve closing element being configured to define a part of the internal bore of the tool assembly.

8. The well tool of claim 6, further comprising a rotation mechanism to cause angular displacement of the switch ram about the longitudinal axis in response to longitudinal movement of the switch ram in the housing, wherein the switch ram is rotationally keyed to the valve closing element and is configured for reciprocating longitudinal movement relative to the housing, to always rotate the valve closing element to the open condition in response to hydraulically actuated longitudinal movement of the switch ram in the activating direction in response to above-threshold drilling fluid conditions, and to always rotate the valve closing element to the closed condition in response to longitudinal movement by the switch ram in an opposite return direction in response to subsequent cessation of the above-threshold drilling fluid conditions.

9. The well tool of claim 8, wherein the switch ram is longitudinally slidable relative to the valve closing element, the valve closing element having a fixed longitudinal position relative to the housing.

10. The well tool of claim 1 further comprising a bias mechanism configured to exert a bias on the switch ram in a longitudinal return direction opposite to the activation direction, the bias mechanism being configured such that the bias matches or exceeds a hydraulic actuating force acting on the switch ram at below-threshold drilling fluid conditions, but is smaller than a hydraulic actuating force acting on the switch ram at above-threshold drilling fluid condition.

11. A drilling installation comprising:

an elongate drill string extending longitudinally along a borehole, the drill string comprising a housing that defines a longitudinally extending internal bore configured to convey drilling fluid under pressure;

a drill string tool forming part of the drill string and configured to be disposable between an activated condition and a deactivated condition;

a control mechanism coupled to the drill string tool and configured to allow operator-controlled switching of the drill string tool by control of drilling fluid pressure conditions, the control mechanism comprising:

a valve body within the housing, the valve body comprising a valve port in fluid communication with the internal bore and with a hydraulic deployment mechanism of the drill string tool;

a valve closing element within the housing and configured for switching between an open condition in which fluid may flow from the internal bore to the activation volume, via the valve port, to pressurize the activation volume and to actuate the hydraulic deployment mechanism, and a closed condition in which the closing element substantially prevents fluid flow through the valve port;

a switch ram within the housing, coupled to the valve closing element, and configured for hydraulically driven movement in an activation direction in response to predefined above-threshold downhole drilling fluid conditions, to switch the valve closing element from the open condition to the closed condition; and a switch regulator within the housing and comprising a flow passage configured to regulate switching of the valve closing element from the closed condition to the open condition by providing regulated hydraulic resistance to movement by the switch ram in the activation direction such that a substantially constant switching duration is maintained regardless of variations in the pressure during above-threshold downhole drilling fluid conditions.

12. The drilling installation of claim 11, wherein the flow passage includes a hydraulic constriction through which a hydraulic medium is flowable in response to movement of the switch ram in the activation direction, the flow passage being configured such that a speed of movement by the switch ram in the activation direction is limited by a rate of flow of the hydraulic medium through the hydraulic constriction.

13. The drilling installation of claim 12, wherein the switch regulator further comprises a flow regulator mounted in the hydraulic constriction and configured to regulate flow of the hydraulic medium through the hydraulic constriction.

14. The drilling installation of claim 13, wherein the flow regulator comprises a flow rate control device configured to restrict a rate of flow of the hydraulic medium through the hydraulic constriction to a predetermined flow rate limit which is substantially consistent and is independent of fluctuations in a pressure differential across the hydraulic constriction during above-threshold drilling fluid conditions.

15. The drilling installation of claim 12, wherein the switch regulator comprises:

a regulator volume filled with the hydraulic medium and configured to be automatically pressurized in response to movement of the switch ram in the activation direction; and wherein the flow passage comprises an evacuation passage providing a fluid flow connection between the regulator volume and an evacuation volume, movement of the switch ram in the activation direction being conditional upon flow of the hydraulic medium through the evacuation passage, so that the evacuation passage provides the hydraulic constriction, the flow regulator being mounted in the evacuation passage.

16. The drilling installation of claim 11, wherein the valve closing element is rotatable relative to the housing about a valve axis for being switched between the open condition and the closed condition.

17. The drilling installation of claim 16, wherein the valve closing element is generally tubular and is located co-axially in the housing, the valve axis being in alignment with a longitudinal axis of the housing, the valve closing element being configured to define a part of the internal bore of the drill string.

18. The drilling installation of claim 16, further comprising a rotation mechanism to cause angular displacement of the switch ram about the longitudinal axis in response to longitudinal movement of the switch ram in the housing, wherein the switch ram is rotationally keyed to the valve closing element and is configured for reciprocating longitudinal movement relative to the housing, to always rotate the valve closing element to the open condition in response to hydraulically actuated longitudinal movement of the switch ram in the activating direction in response to above-threshold drilling fluid conditions, and to always rotate the valve closing element to the closed condition in response to longitudinal movement by the switch ram in an opposite return direction in response to subsequent cessation of the above-threshold drilling fluid conditions.

19. The drilling installation of claim 18, wherein the switch ram is longitudinally slidable relative to the valve closing element, the valve closing element having a fixed longitudinal position relative to the housing.

20. The drilling installation of claim 11, further comprising a bias mechanism configured to exert a bias on the switch ram in a longitudinal return direction opposite to the activation direction, the bias mechanism being configured such that the bias matches or exceeds a hydraulic actuating force acting on the switch ram at below-threshold drilling fluid conditions, but is smaller than a hydraulic actuating force acting on the switch ram at above-threshold drilling fluid condition.

21. A method of controlling a drill string tool coupled in a drill string within a borehole, the drill string defining an internal bore to convey drilling fluid under pressure, the method comprising:

incorporating in a housing of the drill string a control mechanism for the drill string tool, the control mechanism comprising a valve body within the housing, the valve body comprising a valve port that provides fluid communication between with the internal bore and a hydraulic deployment mechanism of the drill string tool;

a valve closing element within the housing and configured for switching between an open condition in which fluid may flow from the internal bore to the activation volume, via the valve port, to pressurize the activation volume and to actuate the hydraulic deployment mechanism, and a closed condition in which the closing element substantially prevents fluid flow through the valve port;

a switch ram within the housing, coupled to the valve closing element, and configured for hydraulically driven movement in an activation direction in response to predefined above-threshold downhole drilling fluid conditions, to switch the valve closing element from the open condition to the closed condition; and a switch regulator within the housing and comprising a flow passage configured to regulate switching of the valve closing element from the closed condition to the open condition by providing regulated hydraulic resistance to movement by the switch ram in the activation direction such that a substantially constant switching duration is maintained regardless of variations in the pressure during above-threshold downhole drilling fluid conditions; and controlling downhole drilling fluid conditions from a surface control system, to cause the predefined above-threshold downhole drilling fluid conditions for longer than the switching duration, thereby switching the valve closing element to the open condition and causing deployment the drill string tool.

* * * * *